US005703037A

United States Patent [19]

Doumen et al.

[11] Patent Number: 5,703,037

[45] Date of Patent: Dec. 30, 1997

[54] PROCESS FOR THE MANUFACTURE OF FREE-FLOWING DETERGENT GRANULES

[75] Inventors: Achille Jules Edmond Doumen, Merchtem; Luc Goovaerts, Haacht; Jose Luis Vega, Strombeek-Bever, all of Belgium

[73] Assignee: The Procter & Gamble Company, Cincinnati, Ohio

[21] Appl. No.: 722,089

[22] PCT Filed: Apr. 20, 1995

[86] PCT No.: PCT/US95/04798

§ 371 Date: Oct. 18, 1996

§ 102(e) Date: Oct. 18, 1996

[87] PCT Pub. No.: WO95/29215

PCT Pub. Date: Nov. 2, 1995

[30] Foreign Application Priority Data

Apr. 20, 1994 [EP] European Pat. Off. ..... 94201090

[51] Int. Cl.[6] ..... C11D 11/00

[52] U.S. Cl. ..... 510/444; 510/350; 510/351; 510/443; 510/452; 510/475; 510/476; 510/504; 510/507; 510/510

[58] Field of Search ..... 510/444, 443, 510/452, 475, 476, 504, 507, 510, 350, 351

[56] References Cited

U.S. PATENT DOCUMENTS

| | | | |
|---|---|---|---|
| 4,379,080 | 4/1983 | Murphy | 510/350 |
| 4,704,221 | 11/1987 | Bleil et al. | 252/91 |
| 4,724,090 | 2/1988 | Suzuki et al. | 252/8.75 |
| 5,066,425 | 11/1991 | Ofosu-Asante et al. | 252/546 |

FOREIGN PATENT DOCUMENTS

| | | | |
|---|---|---|---|
| 0 352 135 A1 | 1/1990 | European Pat. Off. | C11D 11/00 |
| 0 402 112 B1 | 12/1990 | European Pat. Off. | C11D 11/04 |
| 0 438 320 A2 | 7/1991 | European Pat. Off. | C11D 17/06 |
| 0 438 320 A3 | 7/1991 | European Pat. Off. | C11D 11/00 |
| 0508543 | 10/1992 | European Pat. Off. . | |

*Primary Examiner*—Paul Lieberman
*Assistant Examiner*—Lorna M. Douyon
*Attorney, Agent, or Firm*—Jacobus C. Rasser; Jerry J. Yetter; Ken K. Patel

[57] ABSTRACT

A process for the manufacture of free flowing detergent granules having a bulk density of at least 600 g/l, comprises the steps of:

a) neutralising anionic surfactant acid or acids in an excess of alkali to form a paste, and optionally mixing other surfactants with the paste, to give a total surfactant level in the paste of at least 40% by weight;

b) mixing said paste with one or more powders to form a granular product; and c) optionally drying the granular product, wherein at least one of the powders in step b) is spray dried and comprises anionic polymer and cationic surfactant.

12 Claims, No Drawings

PROCESS FOR THE MANUFACTURE OF FREE-FLOWING DETERGENT GRANULES

FIELD OF THE INVENTION

The present invention is concerned with a process for the manufacture of free flowing detergent granules having a bulk density of at least 600 g/l which comprises the addition of a spray dried powder comprising anionic polymer and cationic surfactant.

BACKGROUND OF THE INVENTION

Cationic surfactants are well-known detergent ingredients which are used, in particular, for imparting a soft feel to fabrics after they have been washed. The most commonly used cationic surfactants are commercially available as aqueous solutions, typically with a surfactant activity of about 35% or 40%.

Anionic polymers, such as polycarboxylates are also well-known detergent ingredients. It has been found to be particularly beneficial to incorporate such polymers into surfactant pastes during the process of preparing high density detergent granules. EP508543, published on 12th April 1991 describes a process in which a surfactant paste is structured (or "conditioned") with various agents, including polycarboxylate, prior to an agglomeration step. The addition of the polymer enables higher surfactant activities to be achieved in this process whilst still providing free-flowing, high bulk density detergent granules with a rapid rate of dissolution.

The preparation of lower density granules which comprise both cationic surfactant and anionic polymer has been described. U.S. Pat. No. 4,724,090, 9th February 1988 discloses spray dried powders comprising anionic co-polymers based upon an amide monomer.

Whilst this disclosure provides a method for processing commercially available solutions of cationic surfactant, it is not suitable for use in today's compact detergents because the bulk density of the spray dried product is too low. Alternatively, simply adding cationic surfactant in the form a fine powder to a granular detergent matrix significantly impairs the dispensing properties of the product.

The present invention provides a process for incorporating aqueous solutions of cationic surfactants into free-flowing, high bulk density, high active detergent granules.

The objective of the present invention is achieved by complexing anionic polymer with cationic surfactant in solution. The solution is then spray dried and mixed with high active surfactant pastes, preferably in a twin screw extruder, prior to agglomeration resulting in high active surfactant agglomerates of desirable properties.

SUMMARY OF THE INVENTION

The present invention provides a process for the manufacture of free flowing detergent granules having a bulk density of at least 600 g/l, comprising the steps of:

a) neutralising anionic surfactant acid or acids in an excess of alkali to form a paste, and optionally mixing other surfactants with the paste, to give a total surfactant level in the paste of at least 40% by weight;

b) mixing said paste with one or more powders to form a granular product; and c) optionally drying the granular product, wherein at least one of the powders in step b) is spray dried and comprises anionic polymer and cationic surfactant.

In a preferred process step b) comprises the steps of:

b)(i) mixing said paste with at least one spray dried powder comprising anionic polymer and cationic surfactant to form a homogeneous pasty mixture; and subsequently b)(ii) mixing the homogeneous pasty mixture with additional powders in a high shear mixer to form the granular product.

The spray dried powder which is added in step (b) preferably comprises:

I) from 10 to 90%, most preferably 10 to 70% by weight of a cationic surfactant; and II) from 10 to 90%, most preferably 30 to 90% by weight of a polymer, said polymer comprising functional groups which are anionic.

Furthermore it is preferred that the spray-dried powder comprises less than 10% by weight, preferably less than 5% by weight, (on anhydrous basis) of inorganic components. If however inorganic components are present, the spray dried component should comprise less than 5% by weight (on anhydrous basis) of aluminosilicate, carbonate and tripolyphosphate. It is also preferred that the spray dried powder comprises less than 10%, more preferably less than 1% by weight of anionic surfactant.

A useful anionic polymer (II) is one which comprises carboxylate functional groups. Such a polymer may be selected from the group consisting of water-soluble salts of homo-and copolymers of aliphatic carboxylic acids such as acrylic acid, maleic acid, vinylic acid, itaconic acid, mesaconic acid, fumaric acid, aconitic acid, citraconic acid, methylenemalonic acid, aspartic acid and mixtures thereof. Especially useful are hydrophobically modified polycarboxylates (partially esterified with long chain alcohols).

Most preferably the anionic polymer (II) is a copolymer of maleic and acrylic acid having a molecular weight of from 2,000 to 100,000.

A useful cationic surfactant (I) is a quaternary ammonium salt such as ditallow dimethyl ammonium chloride or coco dimethyl ethoxy ammonium chloride.

DETAILED DESCRIPTION OF THE INVENTION

The Pastes

One or various aqueous pastes of the salts of anionic surfactants, and optionally nonionic surfactants are preferred for use in the present invention, preferably comprising the sodium salt of the anionic surfactant. In a preferred embodiment, the anionic surfactant, or anionic/nonionic surfactant mix is preferably as concentrated as possible, (that is, with the lowest possible moisture content that allows it to flow in the manner of a liquid) so that it can be pumped at temperatures at which it remains stable. While granulation using various pure or mixed surfactants is known, for the present invention to be of practical use in industry and to result in particles of adequate physical properties to be incorporated into granular detergents, a surfactant must be part of the paste in a concentration of preferably from 40% to 95%, more preferably from 60% to 85% by weight.

It is preferred that the moisture in the surfactant aqueous paste is as low as possible, while maintaining paste fluidity, since low moisture leads to a higher concentration of the surfactant in the finished particle. Preferably the paste contains between 0 and 40% water, more preferably between 5 and 30% water and most preferably between 5% and 20% water. A highly attractive mode of operation for lowering the moisture of the paste prior to entering the agglomerator without problems with very high viscosities is the installation, in line, of an atmospheric or a vacuum drier whose outlet is connected to the agglomerator.

It is preferable to use high active surfactant pastes to minimize the total water level in the system during mixing, granulating and drying. Lower water levels allow for: (1) a higher active surfactant to builder ratio, e.g., 1:1; (2) higher levels of other liquids in the formula without causing dough or granular stickiness; and (3) less granular drying to meet final moisture limits.

Two important parameters of the surfactant pastes which can affect the mixing and granulation step are the paste temperature and viscosity. Viscosity is a function, among others, of concentration and temperature, with a range in this application up to about 10,000 Pas. Preferably, the viscosity of the paste entering the system is from about 1 Pas to about 100 Pas. and more preferably from about 10 Pas to about 70 Pas. The viscosity of the paste of this invention is measured at a temperature of 70° C. and a shear rate of 25 $s^{-1}$.

The paste can be introduced into the mixer at an initial temperature between its softening point (generally in the range of 20°–60° C.) and its degradation point (depending on the chemical nature of the paste, e.g. alkyl sulphate pastes tend to degrade above 75°–85° C.). High temperatures reduce viscosity simplifying the pumping of the paste but result in lower active agglomerates. The use of in-line cooling steps are preferred ways to increase agglomerate activity. The use of in-line moisture reduction steps (e.g. flash drying), however, require the use of higher temperatures (above 100° C.). In the present invention, the activity of the agglomerates is maintained high due to the elimination of moisture.

The introduction of the paste into the mixer can be done in many ways, from simply pouring to high pressure pumping through small holes at the end of the pipe, before the entrance to the mixer. While all these ways are viable to manufacture agglomerates with good physical properties, it has been found that in a preferred embodiment of the present invention the extrusion of the paste results in a better distribution in the mixer which improves the yield of particles with the desired size. The use of high pumping pressures prior to the entrance in the mixer results in an increased activity in the final agglomerates. By combining both effects, and introducing the paste through holes (extrusion) small enough to allow the desired flow rate but that keep the pumping pressure to a maximum feasible in the system, highly advantageous results are achieved.

High Active Surfactant Paste

The activity of the aqueous surfactant paste is at least 40% and can go up to about 95%; preferred activities are 60% to 85%, most preferred are 70% to 85%. At the higher active concentrations, little or no builder is required for cold granulation of the paste. The resultant high active surfactant granules can be added to dry builders or powders or used in conventional agglomeration operations. The aqueous surfactant paste contains an organic surfactant selected from the group consisting of anionic, nonionic, zwitterionic, ampholytic and cationic surfactants, and mixtures thereof. Anionic surfactants, and mixtures of anionic and nonionic surfactants are preferred. Surfactants useful herein are listed in U.S. Pat. No. 3,664,961, Norris, issued May 23, 1972, and in U.S. Pat. No. 3,919,678, Laughlin et al., issued Dec. 30, 1975. The following are representative examples of surfactants useful in the present compositions.

Water-soluble salts of the higher fatty acids, i.e., "soaps", are useful anionic surfactants in the compositions herein. This includes alkali metal soaps such as the sodium, potassium, ammonium, and alkylammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkyl benzene sulfonates in which the alkyl group contains from about 9 to about 15 carbon atoms, in straight or branched chain configuration, e.g., those of the type described in U.S. Pat. Nos. 2,220,099 and 2,477,383. Especially valuable are linear straight chain alkyl benzene sulfonates in which the average number of carbon atoms in the alkyl group is from about 11 to 13, abbreviated as $C_{11}$–$C_{13}$ LAS.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; watersoluble salts of olefin sulfonates containing from about 12 to 24 carbon atoms; and beta-alkyloxy alkane sulfonates containing from about 1 to 3 carbon atoms in the alkyl group and from about 8 to about 20 carbon atoms in the alkane moiety. Although the acid salts are typically discussed and used, the acid neutralization cam be performed as part of the fine dispersion mixing step.

Water-soluble nonionic surfactants are also useful as surfactants in the compositions of the invention. Indeed, preferred processes use anionic/nonionic blends. A particularly preferred paste comprises a blend of nonionic and anionic surfactants having a ratio of from about 0.01:1 to about 4:1. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 16 carbon atoms, in either a straight chain or branched chain configuration, with from about 4 to 25 moles of ethylene oxide per mole of alkyl phenol.

Preferred nonionics are the water-soluble condensation products of aliphatic alcohols containing from 8 to 22 carbon atoms, in either straight chain or branched configuration, with from 2 to 25 moles of ethylene oxide per more of alcohol. Particularly preferred are the condensation products of alcohols having an alkyl group containing from about 9 to 15 carbon atoms with from about 2 to 25 moles of ethylene oxide per mole of alcohol; and condensation products of propylene glycol with ethylene oxide.

Other preferred nonionics are polyhydroxy fatty acid amides, such as tallow N-methyl glucose amide, and alkyl poly glucoside.

Semi-polar nonionic surfactants include water-soluble amine oxides containing one alkyl moiety of from about 10 to 18 carbon atoms and 2 moieties selected from the group consisting of alkyl groups and hydroxyalkyl groups containing from 1 to about 3 carbon atoms; water-soluble phosphine oxides containing one alkyl moiety of about 10 to 18 carbon atoms and 2 moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be either straight or branched chain and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium phosphonium, and sulfonium compounds in which one of the aliphatic substituents contains from about 8 to 18 carbon atoms.

Incorporation of Spray Dried Powder

Preferred cationic surfactants are water soluble quaternary ammonium salts containing one or two long alkyl groups containing from 10 to 14 carbon atoms and 2 or 3 short alkyl groups each of which contain no more than 2 carbon atoms and optionally have ethoxy groups.

Useful cationic surfactants include water-soluble quaternary ammonium compounds of the form $R_4R_5R_6R_7N^+X^-$, wherein $R_4$ is alkyl having from 10 to 20, preferably from 12–18 carbon atoms, and $R_5$ is $C_1$ to $C_{20}$, $R_6$ and $R_7$ are each $C_1$ to $C_7$ alkyl preferably methyl; $X^-$ is an anion, e.g. chloride. Examples of such trimethyl ammonium compounds include $C_{12-14}$ alkyl trimethyl ammonium chloride, $C_{12-14}$ alkyl dimethyl ethoxy ammonium chloride and cocalkyl trimethyl ammonium methosulfate. Other useful cationic surfactants are described in U.S. Pat. No. 4,222,905, Cockrell, issued Sep. 16, 1990 and in U.S. Pat. No. 4,239,659, Murphy, issued Dec. 16, 1980.

Useful organic polymers may also function as builders to improve detergency. Included among such polymers may be mentioned sodium carboxy-lower alkyl celluloses, sodium lower alkyl celluloses and sodium hydroxy-lower alkyl celluloses, such as sodium carboxymethyl cellulose, sodium methyl cellulose and sodium hydroxypropyl cellulose, polyacrylates and various copolymers, such as those of maleic and acrylic acids. Molecular weights for such polymers vary widely but most are within the range of 2,000 to 100,000.

Polymeric polycarboxyate builders are set forth in U.S. Pat. No. 3,308,067, Diehl, issued Mar. 7, 1967. Such materials include the water-soluble salts of homo-and copolymers of aliphatic carboxylic acids such as acrylic acid, maleic acid, vinylic acid, itaconic acid, mesaconic acid, fumaric acid, aconitic acid, citraconic acid methylenemalonic acid, and aspartic acid.

The spray dried powder comprising the cationic surfactant and anionic polymer may be prepared by any conventional method, such as spray drying using pressure nozzle, two-fluid nozzle or spinning disc atomiser. The spinning disc atomiser and the two fluid nozzle are preferred.

The spray dried powder is preferably mixed with the high active surfactant paste to form a uniform pasty mixture. Optionally, the high active paste may also be thickened or "structured". Suitable thickening or structuring agents are fatty acids, fatty acid soaps, silicates and polymers. It is preferred that the mixing of this processing step is carried out in an extruder.

The Extruder

The extruder fulfills the functions of pumping and mixing the viscous surfactant paste on a continuous basis. A basic extruder consists of a barrel with a smooth inner cylindrical surface. Mounted within this barrel is the extruder screw. There is an inlet port for the high active paste which, when the screw is rotated, causes the paste to be moved along the length of the barrel.

Additional ports in the barrel may allow other ingredients, including the spray dried powder to be added directly into the barrel.

A preferred extruder is the twin screw extruder. This type of extruder has two screws mounted in parallel within the same barrel, which are made to rotate either in the same direction (co-rotation) or in opposite directions (counter-rotation). The co-rotating twin screw extruder is the most preferred piece of equipment for use in this invention.

Suitable twin screw extruders for use in the present invention include those supplied by: APV Baker, (CP series); Werner and Pfleiderer, (Continua Series); Wenger, (TF Series); Leistritz, (ZSE Series); and Buss, (LR Series).

The High Shear Mixing and Granulation

The term "high shear mixing" as used herein, means mixing and/or granulation of the above pasty mixture with powders in a high shear mixer at a blade tip speed of from about 5 m/sec. to about 50 m/sec., unless otherwise specified. The total residence time of the mixing and granulation process is preferably in the order of from 0.1 to 10 minutes, more preferably 0.1–5 and most preferably 0.2–4 minutes. The more preferred mixing and granulation tip speeds are about 10–45 m/sec. and about 15–40 m/sec.

The ratio of pasty mixture to powder should be chosen in order to maintain discrete particles at all stages of the process. These particles may be sticky but must be substantially free flowing so that the mixing and granulation steps can be carried out simultaneously, or immediately sequentially without causing blockage of the mixer/granulator.

Any apparatus, plants or units suitable for the processing of surfactants can be used for carrying out the process according to the invention. Suitable apparatus includes, for example, falling film sulphonating reactors, digestion tanks, esterification reactors, etc. For mixing/agglomeration any of a number of mixers/agglomerators can be used. In one preferred embodiment, the process of the invention is continuously carried out. Especially preferred are mixers of the Fukae® FS-G series manufactured by Fukae Powtech Kogyo Co., Japan; this apparatus is essentially in the form of a bowl-shaped vessel accessible via a top port, provided near its base with a stirrer having a substantially vertical axis, and a cutter positioned on a side wall. The stirrer and cutter may be operated independently of one another and at separately variable speeds. The vessel can be fitted with a cooling jacket or, if necessary, a cryogenic unit.

Other similar mixers found to be suitable for use in the process of the invention inlcude Diosna® V series ex Dierks & Söhne, Germany; and the Pharma Matrix® ex T K Fielder Ltd., England. Other mixers believed to be suitable for use in the process of the invention are the Fuji® VG-C series ex Fuji Sangyo Co., Japan; and the Roto® ex Zanchetta & Co srl, Italy.

Other preferred suitable equipment can include Eirich®, series RV, manufactured by Gustau Eirich Hardheim, Germany; Lödige®, series CB and KM in series for continuous mixing/agglomeration, manufactured by Lödige Machinenbau GmbH, Paderborn Germany; Drais® T160 series, manufactured by Drais Werke GmbH, Mannheim Germany; and Winkworth® RT 25 series, manufactured by Winkworth Machinery Ltd., Bershire, England.

The Littleford Mixer, Model #FM-130-D-12, with internal chopping blades and the Cuisinart Food Processor, Model #DCX-Plus, with 7.75 inch (19.7 cm) blades are two examples of suitable mixers. Any other mixer with fine dispersion mixing and granulation capability and having a residence time in the order of 0.1 to 10 minutes can be used. The "turbine-type" impeller mixer, having several blades on an axis of rotation, is preferred. The invention can be practiced as a batch or a continuous process.

Operating Temperatures

Preferred operating temperatures should also be as low as possible since this leads to a higher surfactant concentration in the finished particle. Preferably the temperature during the agglomeration is less than 100° C., more preferably between 10° and 90° C., and most preferably between 25° and 80° C. Lower operating temperatures useful in the process of the present invention may be achieved by a variety of methods known in the art such as nitrogen cooling, cool water jacketing of the equipment, addition of solid $CO_2$, and the like; with a preferred method being solid $CO_2$, and the most preferred method being nitrogen cooling.

Powders

Many powders are suitable for use in the granulation step of the present process. Prefered powders for use in the process and compositions of the present invention are compatible detergency builder or combination of builders or powder.

The detergent compositions herein can contain crystalline aluminosilicate ion exchange material of the formula $$Na_z[(AlO_2)_z.(SiO_2)_y].xH_2O$$

wherein z and y are at least about 6, the molar ratio of z to y is from about 1.0 to about 0.4 and z is from about 10 to about 264. Amorphous hydrated aluminosilicate materials useful herein have the empirical formula $$M_z(zAlO_2.ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate. Hydrated sodium Zeolite A with a particle size of from about 1 to 10 microns is preferred.

The aluminosilicate ion exchange builder materials herein are in hydrated form and contain from about 10% to about 28% of water by weight if crystalline, and potentially even higher amounts of water if amorphous. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron. Preferred ion exchange materials have a particle size diameter of from about 0.2 micron to about 4 microns. The term "particle size diameter" herein represents the average particle size diameter by weight of a given ion exchange material as determined by conventional analytical techniques such as, for example, microscopic determination utilizing a scanning electron microscope. The crystalline aluminosilicate ion exchange materials herein are usually further characterized by their calcium ion exchange capacity, which is at least about 200 mg equivalent of $CaCO_3$ water hardness/g of aluminosilicate, calculated on an anhydrous basis, and which generally is in the range of from about 300 mg eq./g to about 352 mg eq./g. The aluminosilicate ion exchange materials herein are still further characterized by their calcium ion exchange rate which is at least about 2 grains $Ca^{++}$/gallon/minute/gram/gallon of aluminosilicate (anhydrous basis), and generally lies within the range of from about 2 grains/gallon/minute/gram/gallon to about 6 grains/gallon/minute/gram/gallon, based on calcium ion hardness. Optimum aluminosilicate for builder purposes exhibit a calcium ion exchange rate of at least about 4 grains/gallon/minute/gram/gallon.

The amorphous aluminosilicate ion exchange materials usually have a $Mg^{++}$ exchange of at least about 50 mg eq. $CaCO_3$/g (12 mg $Mg^{++}$/g) and a $Mg^{++}$ exchange rate of at least about 1 grain/gallon/minute/gram/gallon. Amorphous materials do not exhibit an observable diffraction pattern when examined by Cu radiation (1.54 Angstrom Units).

Aluminosilicate ion exchange materials useful in the practice of this invention are commercially available. The aluminosilicates useful in this invention can be crystalline or amorphous in structure and can be naturally occurring aluminosilicates or synthetically derived. A method for producing aluminosilicate ion exchange materials is discussed in U.S. Pat. No. 3,985,669, Krummel et al., issued Oct. 12, 1976, incorporated herein by reference. Preferred synthetic crystalline aluminosilicate ion exchange materials useful herein are available under the designations Zeolite A, Zeolite B, Zeolite P, Zeolite MAP and Zeolite X. In an especially preferred embodiment, the crystalline aluminosilicate ion exchange material has the formula $$Na_{12}[(AlO_2)_{12}(SiO_2)_{12}].xH_2O$$

wherein x is from about 20 to about 30, especially about 27 and has a particle size generally less than about 5 microns.

The granular detergents of the present invention can contain neutral or alkaline salts which have a pH in solution of seven or greater, and can be either organic or inorganic in nature. The builder salt assists in providing the desired density and bulk to the detergent granules herein. While some of the salts are inert, many of them also function as detergency builder materials in the laundering solution.

Examples of neutral water-soluble salts include the alkali metal, ammonium or substituted ammonium chlorides, fluorides and sulfates. The alkali metal, and especially sodium, salts of the above are preferred. Sodium sulfate is typically used in detergent granules and is a particularly preferred salt. Citric acid and, in general, any other organic or inorganic acid may be incorporated into the granular detergents of the present invention as long as it is chemically compatible with the rest of the agglomerate composition.

Other useful water-soluble salts include the compounds commonly known as detergent builder materials. Builders are generally selected from the various water-soluble, alkali metal, ammonium or substituted ammonium phosphates, polyphosphates, phosphonates, polyphosphonates, carbonates, silicates, borates, citrates, silicas and polyhyroxysulfonates. Preferred are the alkali metal, especially sodium, salts of the above.

Specific examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, incorporated herein by reference.

Examples of nonphosphorus, inorganic builders are sodium and potassium carbonate, bicarbonate, sesquicarbonate, tetraborate decahydrate, and silicate having a molar ratio of $SiO_2$ to alkali metal oxide of from about 0.5 to about 4.0, preferably from about 1.0 to about 2.4. Highly preferred materials within the silicate class are crystalline layered sodium silicates of general formula:

$$NaMSiO_{2x+1}.YH_2O$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. For the purposes of the present invention, x in the general formula above has a value of 2, 3 or 4 and is preferably 2. More preferably M is sodium and y is 0 and preferred examples of this formula comprise the y and δ forms of $Na_2Si_2O_5$. These materials are available from Hoechst AG FRG as respectively NaSKS-11 and NaSKS-6. The most preferred material is δ-$Na_2Si_2O_5$, (NaSKS-6). Crystalline layered silicates are incorporated either as dry mixed solids, or as solid components of agglomerates with other components.

The compositions made by the process of the present invention does not require excess carbonate for processing, and preferably does not contain over 2% finely divided calcium carbonate as disclosed in U.S. Pat. No. 4,196,093, Clarke et al., issued Apr. 1, 1980, and is preferably free of the latter.

EXAMPLES

All % are percent by weight unless otherwise specified

Example 1 a) Formulation of the Spray-Dried Particle

The following free flowing powder composition was prepared:

| | |
|---|---|
| Acrylic/Maleic copolymer (MW = 50000) | 61% |
| Fatty alkyldimethylhydroxyethylammoniumchloride | 30% |
| Water | 9% |
| | 100% |

The composition was prepared by mixing a 40% active solution of the sodium salt of the copolymer and a 40% active solution of fatty alkyldimethylhydroxethylammoniumchloride to give a well mixed slurry.

The slurry was then processed through a continuous spray dryer with concurrent air inlet and a rotating disc (15000 rpm) at the top of the tower. After the exit from the bottom of the tower, the product is further dried and cooled in a fluid bed dryer and fluid bed cooler in series.

After classification (removal of fines and oversize particles) by vibrating screens, the resulting spray dried powder had an apparent bulk density of 250 g/l.

b) Incorporation of Spray-Dried Powder into a High Density Granule

An aqueous surfactant paste was prepared comprising:

62.5% by weight sodium alkyl sulphate having substantially C12, C14 and C15 alkyl chains;

15.5% by weight sodium alkyl ethoxy sulphate having substantially C12 to C15 alkyl chains and an average of 3 ethoxy groups per molecule;

17% by weight of water and the balance being mainly comprised of unreacted alcohol and sulphates.

The aqueous surfactant paste and the powder compound described in example one were intimately mixed in a twin screw extruder (manufactured by Werner & Pfleiderer, C170). The resulting viscous paste was extruded (at a temperature of 60° C.) directly into a Loedige CB30 (trade name) high speed mixer containing a mixture of 2 part zeolite A to 1 part finely divided light carbonate.

The mixer operates on a continuous basis and discharges directly into a Loedige KM 3000 (trade name) continuous ploughshare mixer. The resulting agglomerates were transferred to a fluid bed drier, cooled in a fluid bed cooler and then classified through mesh sieves to remove oversize and fine particles. The agglomerates formed have an anionic surfactant content of 40% by weight, a polymer level of 14%, a cationic surfactant level of 7% and an equilibrium relative humidity level of 10% at room temperature.

The granules have an apparent bulk density of 680 g/l and have excellent flow and handling properties.

Example 2

The following free flowing powder composition was prepared by the same process as described in example 1 (a).

| | |
|---|---|
| Acrylic/Maleic copolymer (MW = 50000) | 45% |
| Fatty alkyldimethylhydroxyethylammoniumchloride | 45% |
| Water | 10% |
| | 100% |

This powder had a bulk density of 300 g/L.

This powder was then incorporated into a free flowing, high density particle, by the same process as described in example 1 (b), (except that the composition of the powder mixture entering the high speed mixer was: Zeolite A, 42%; light sodium carbonate 58%) to give a free flowing granular product having an anionic surfactant content of 40%, a polymer content of 7%, a cationic surfactant level of 7%, and an equilibrium relative humidity level of 10% at room temperature.

The granules have an apparent bulk density of 700 g/l and have excellent flow and handling properties.

We claim:

1. A process for the manufacture of free flowing detergent granules having a bulk density of at least 600 g/l, comprising the steps of:

a) neutralizing anionic surfactant acid or acids in an excess of alkali to form a paste, and optionally mixing other surfactants with the paste, to give a total surfactant level in the paste of at least 40% by weight;

b) mixing said paste with at least one spray dried powder comprising at least about 10% by weight of each of anionic polymer and a cationic surfactant to form a granular product; and c) optionally drying the granular product.

2. A process according to claim 1 in which step b) comprises the steps of:

b)(i) mixing said paste with at least one spray dried powder comprising anionic polymer and cationic surfactant to form a homogeneous pasty mixture; and subsequently b)(ii) mixing the homogeneous pasty mixture with additional powders in a high shear mixer to form the granular product.

3. A process according to claim 1 wherein the spray dried powder comprises:

I) from 10 to 90% by weight of a cationic surfactant

II) from 10 to 90% by weight of a polymer, said polymer comprising functional groups which are anionic.

4. A process according to claim 3 wherein the spray dried powder comprises less than 10% by weight on anhydrous basis of inorganic components.

5. A process according to claim 4 wherein the spray dried powder comprises less than 5% by weight on anhydrous basis of inorganic components.

6. A process according to claim 5 wherein the spray dried powder comprises less than 5% by weight on anhydrous basis of aluminosilicate, carbonate and tripolyphosphate.

7. A process according to claim 3 wherein the spray dried powder comprises less than 10% by weight of anionic surfactant.

8. A process according to claim 7 wherein the spray dried powder comprises less than 1% by weight of anionic surfactant.

9. A process according to claim 3 wherein the polymer (II) comprises carboxylate functional groups.

10. A process according to claim 9 wherein the polymer (II) is selected from the group consisting of water-soluble salts of homo-and copolymers of aliphatic carboxylic acids selected from the group consisting of acrylic acid, maleic acid, vinylic acid, itaconic acid, mesaconic acid, fumaric acid, aconitic acid, citraconic acid, methylenemalonic acid, aspartic acid and mixtures thereof.

11. A process according to claim 10 wherein the polymer (II) is a copolymer of maleic and acrylic acid having a molecular weight of from 2,000 to 100,000.

12. A process according to claim 3, wherein the cationic surfactant (I) is a quaternary ammonium salt.

* * * * *